US009350110B1

(12) United States Patent
Ma

(10) Patent No.: US 9,350,110 B1
(45) Date of Patent: May 24, 2016

(54) ELECTRICAL CONNECTOR HAVING IMPROVED TERMINALS

(71) Applicant: FOXCONN INTERCONNECT TECHNOLOGY LIMITED, Grand Cayman (KY)

(72) Inventor: Hao-Yun Ma, San Jose, CA (US)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 30 days.

(21) Appl. No.: 14/529,106

(22) Filed: Oct. 30, 2014

(51) Int. Cl.
*H01R 12/00* (2006.01)
*H01R 13/52* (2006.01)
*H01R 24/60* (2011.01)

(52) U.S. Cl.
CPC ..... *H01R 13/521* (2013.01); *H01R 24/60* (2013.01)

(58) Field of Classification Search
CPC ..... H01R 13/521; H01R 24/60
USPC ..... 439/79, 660, 676
See application file for complete search history.

(56) References Cited

U.S. PATENT DOCUMENTS 7,785,149 B2 * 8/2010 Kamata ..... H01R 13/6275 439/570
8,956,187 B2 * 2/2015 He ..... H01R 13/504 439/607.35
2013/0183844 A1 7/2013 Wang

* cited by examiner

*Primary Examiner* — Khiem Nguyen
(74) *Attorney, Agent, or Firm* — Wei Te Chung; Ming Chieh Chang

(57) ABSTRACT

An electrical connector includes an insulative housing defining a base portion and a mating tongue forwardly extending from the base portion, and a plurality of terminals insert molded in the housing. Each of the terminals defines a horizontal portion with a contacting section exposed upon the mating tongue, a tail portion bending out of the base portion, and a retaining section disposed between the horizontal portion and the tail portion and fully embedded within the base portion without exposure. The horizontal portion is provided in a rectangular shape, and at least a portion of the retaining section is provided in a round shape to provide good waterproof function with lower cost.

19 Claims, 6 Drawing Sheets

ELECTRICAL CONNECTOR HAVING IMPROVED TERMINALS

BACKGROUND OF THE INVENTION

1. Field of the Invention

The present invention relates to an electrical connector, and more particular to an electrical connector having improved terminals for good waterproof function.

2. Description of the Related Art

US Pat. Pub No. 2013/0183844 published on Jul. 18, 2013 discloses an electrical connector mainly including a metallic shell, an insulating housing combined to the metallic shell, a plurality of terminals insert-molded in the insulating housing, an insulative cover covering the metallic shell, a waterproof ring encircling a front end of the insulative cover, and a waterproof plate attached to a rear face of the insulative cover. The insulative cover assembled with the waterproof ring and the waterproof plate can provide good waterproof function for the electrical connector. However, the terminals each defines a rectangular retention portion, and when the terminals are insert-molded in the housing, gaps will exist between the rectangular retention portion and the housing due to uneven after-molding plastic shrinking of the housing. Thereby, the waterproof plate is necessary to be added to fully seal the gaps, which may increase assemblage steps and product cost of the electrical connector.

Therefore, a new design is required.

SUMMARY OF THE INVENTION

Accordingly, an object of the present invention is to provide an electrical connector having improved terminals for good waterproof function with lower cost.

In order to achieve the object set forth, an electrical connector includes an insulative housing defining a rear base portion and a mating tongue forwardly extending from the base portion in a front-to-back direction and a plurality of terminals insert-molded in the housing to be integrally formed with the mating tongue and the base portion. Each of the terminals defines a horizontal portion with a contacting section exposed upon the mating tongue, a tail portion bending out of the base portion for mounting to a printed circuit board, and a retaining section disposed between the horizontal portion and the tail portion and fully embedded within the base portion without exposure. The horizontal portion is provided in a rectangular shape, and at least a portion of the retaining section is provided in a round shape.

Other objects, advantages and novel features of the invention will become more apparent from the following detailed description of the present embodiment when taken in conjunction with the accompanying drawings.

DETAILED DESCRIPTION OF THE INVENTION

Figure 1:
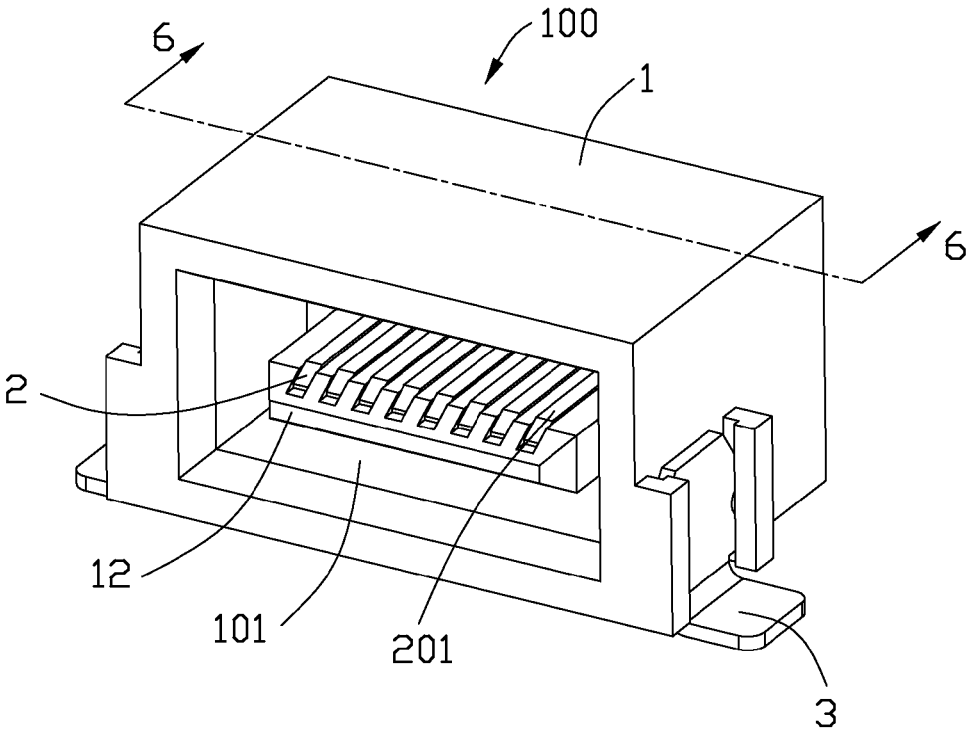
FIG. 1 is a perspective view of an electrical connector in accordance with the present invention.

Reference will now be made to the drawing figures to describe a preferred embodiment of the present invention in detail. Referring to FIG. 1, the electrical connector 100 mainly includes an insulative housing 1, a plurality of terminals 2 insert-molded in the housing 1, and a pair of metal ears 3 retained at two opposite sides of the housing 1 respectively.

Figure 2:
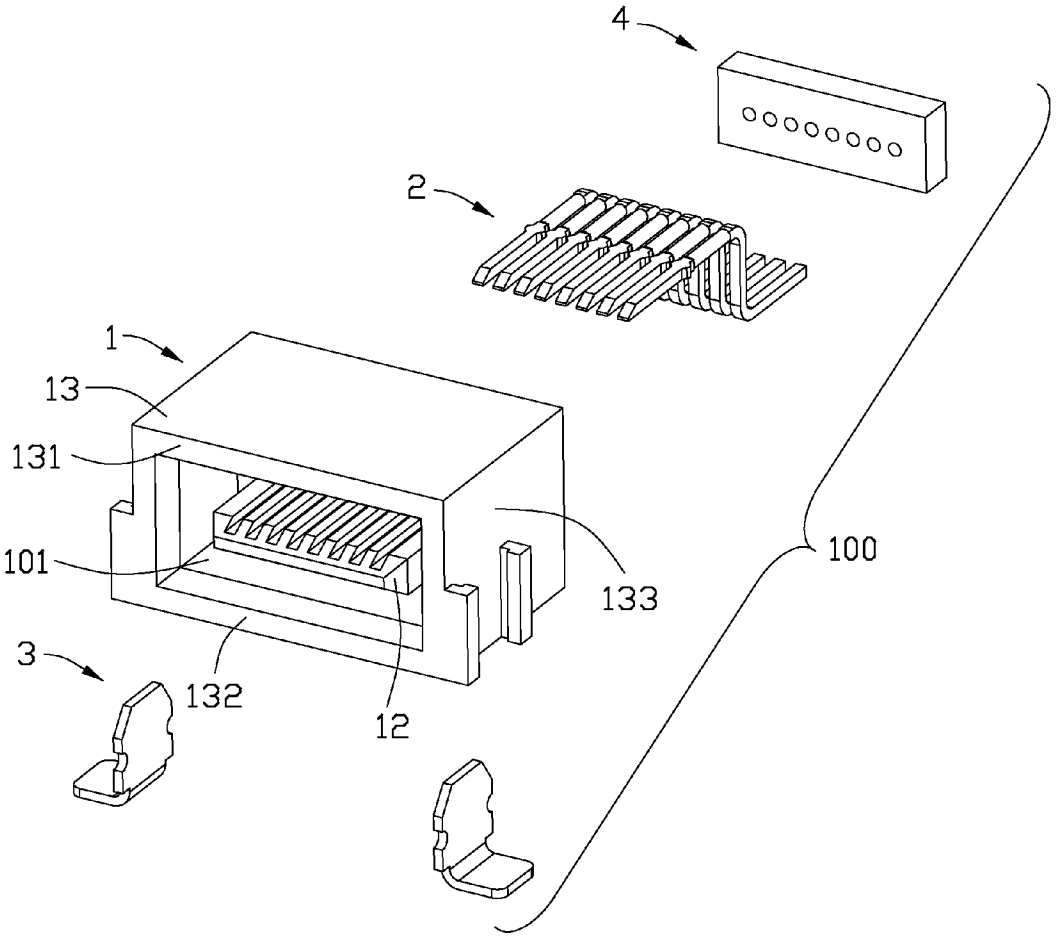
FIG. 2 is an exploded perspective view of the electrical connector shown in FIG. 1.
Figure 3:
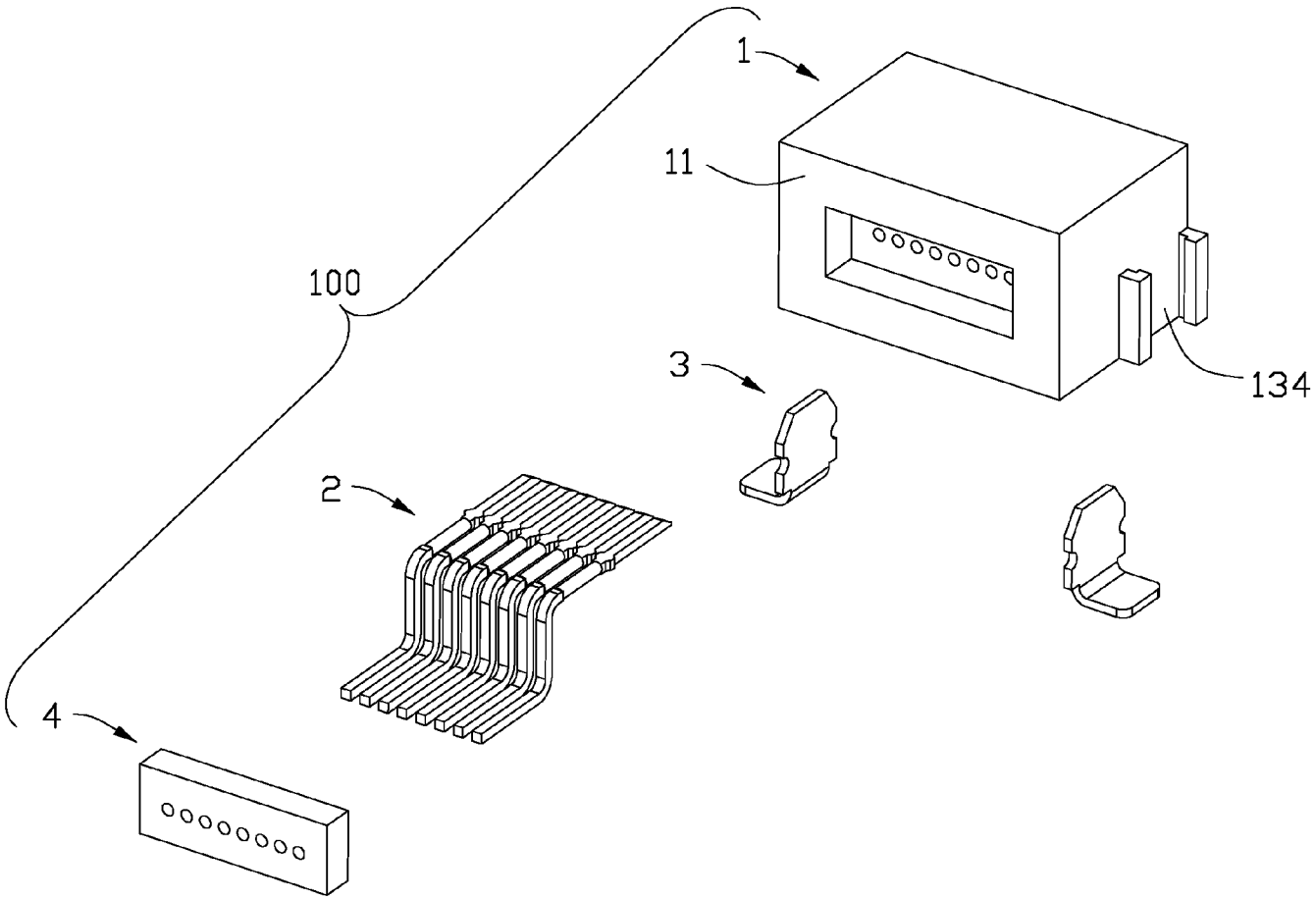
FIG. 3 is another exploded perspective view of the electrical connector shown in FIG. 2.
Figure 4:
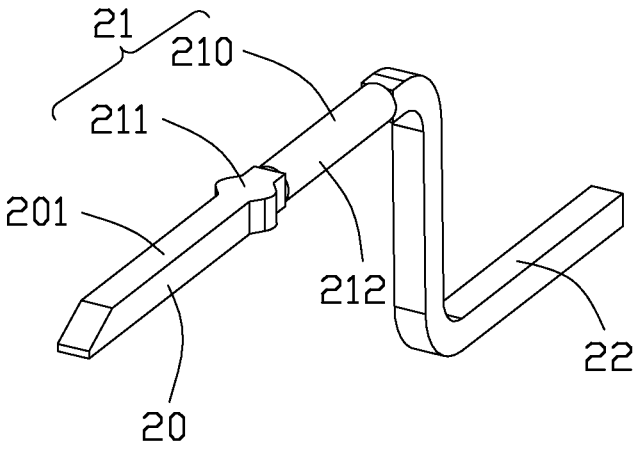
FIG. 4 is a perspective view of a terminal shown in FIG. 2.
Figure 5:
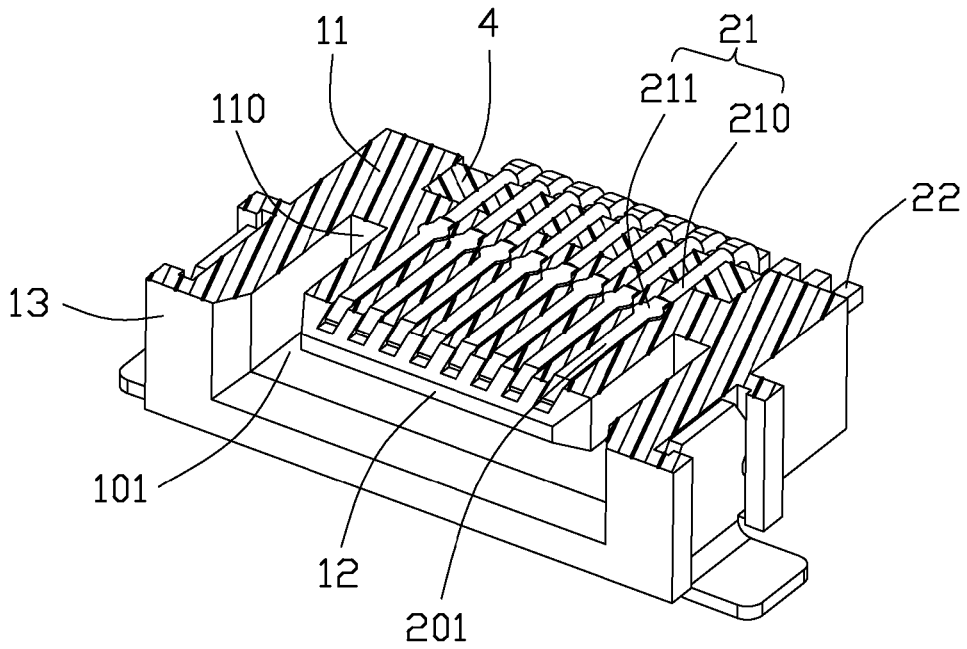
FIG. 5 is a perspective view of the electrical connector shown in FIG. 1 with an upper portion removed.
Figure 6:
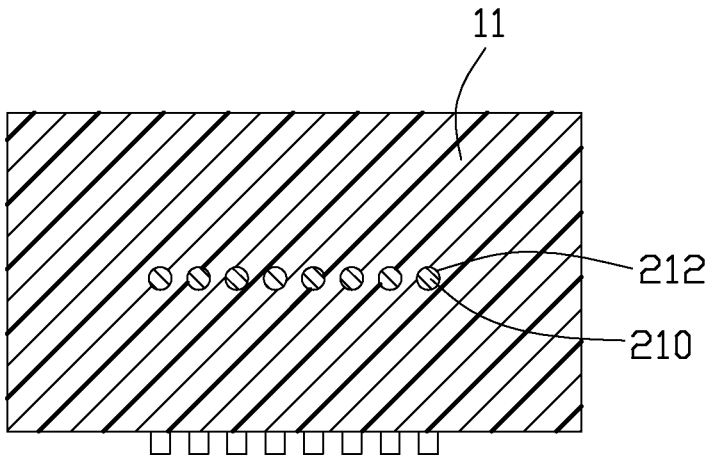
FIG. 6 is a cross-sectional view of the electrical connector taken along line 6-6 of FIG. 1.

Referring to FIG. 2, FIG. 3 and FIG. 5, the housing 1 defines a rear base portion 11, a mating tongue 12 forwardly extending in a mating direction from a front face 110 of the base portion 11, and a mating frame 13 forwardly extending in the mating direction from the front face 110 to surround the mating tongue 12 and dispose the mating tongue 12 in a mating cavity 101. The mating frame 13 defines opposite upper and lower walls 131, 132 each parallel to the mating tongue 12, and a pair of side walls 133 respectively connecting with the upper and lower walls 131, 132 at two sides thereof. Each side wall 133 is perpendicular to the mating tongue 12 and provides a retaining slot 134 at a peripheral face thereof.

Referring to FIG. 1, and FIG. 4 to FIG. 6, each of the terminals 2 defines a horizontal portion 20 with a contacting section 201 exposed upon the mating tongue 12, a tail portion 22 bending out of the base portion 11 for mounting to a printed circuit board, and a connecting portion 21 linked between the horizontal portion 20 and the tail portion 22. The horizontal portion 20 and the tail portion 22 both are provided in rectangular shape. The connecting portion 21 includes a retaining section 210 fully embodied within the base portion 11 without exposure and a rectangular barb portion 211 connecting with the horizontal portion 20, at least a portion of the retaining section 210 is provided in a round shape. The terminals 2 are retained in the housing 1 via an insert-molding process, with the round shape portion of the retaining section 210 in the insert-molding housing 1, after-molding plastic shrinking of the housing 1 would be more even than that a traditional rectangular shape retaining section insert-molded in the housing, a round-shaped peripheral surface 212 of the round shape portion of the retaining section 210 would impinge on the base portion 11 and no gaps will emerge between the round shape portion of the retaining section 210 and the base portion 11 of the housing 1, which can effectively prevent water or etc from entering. In other embodiment, at least a portion of the retaining section 210 can be provided with an arc-shaped peripheral surface. Moreover, the rectangular shape barb portion 211 can be removed, and the retaining section 210 directly links the horizontal portion 20 and the tail portion 22 to be defined as the connecting portion 21.

The pair of metal ears 3 each is retained in a corresponding retaining slot 134 for securely fixing the electrical connector to a printed circuit board. A waterproof plate 4 is provided to attach to a rear portion of the base portion 11, and the tail portions 22 of the terminals 2 extend out of the waterproof plate 4. In this embodiment, the waterproof plate 14 is terminated on the retaining portion 210 with the round shape therewith. Anyhow, the waterproof plate 4 may further rearwardly extend to terminate on a front end region of the tail portion 22 having the rectangular shape therewith. Obviously, the round shape retaining section 210 cooperating with the base portion 11 without any gap emerged therebetween already can provide a good waterproof function for the electrical connector 100, so that the waterproof plate 4 also can be removed to reduce assemblage steps and cost of the electrical connector 100. In other words, the waterproof 4 shown in the drawings may be replaced with the portions unitarily formed with the base portion 11 with the same material for ease manufacturing.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an insulative housing defining a rear base portion and a mating tongue forwardly extending from the base portion in a front-to-back direction; and a plurality of terminals insert-molded in the housing to be integrally formed with the mating tongue and the base portion, each of the terminals defining a horizontal portion with a contacting section exposed upon the mating tongue, a tail portion bending out of the base portion for mounting to a printed circuit board, and a retaining section disposed between the horizontal portion and the tail portion and fully embedded within the base portion without exposure;

wherein the horizontal portion is provided in a rectangular shape, and at least a portion of the retaining section is provided in a round shape.

2. The electrical connector as described in claim 1, wherein each terminal comprises a barb portion linked between the horizontal portion and the retaining section.

3. The electrical connector as described in claim 1, wherein the tail portion is provided in a rectangular shape.

4. The electrical connector as described in claim 1, wherein the housing comprises a mating frame unitarily forwardly extending from the base portion in the mating direction to surround the mating tongue and dispose the mating tongue in a mating cavity, the horizontal portion is disposed in the mating cavity.

5. The electrical connector as described in claim 4, wherein the mating frame defines opposite upper and lower walls both parallel to the mating tongue, and a pair of side walls respectively connecting with the upper and lower walls at two sides thereof, each side wall is perpendicular to the mating tongue.

6. The electrical connector as described in claim 5, wherein at least one of the side walls provides a retaining slot at a peripheral face thereof, and a metal ear is provided to be retained in the corresponding retaining slot.

7. The electrical connector as described in claim 1, further comprising a waterproof plate attached to a rear portion of the base portion, wherein the tail portions extend out of the waterproof plate.

8. An electrical connector, comprising:

an insulative housing defining a rear base portion and a mating tongue forwardly extending from the base portion in a front-to-back direction; and a plurality of terminals insert-molded in the housing to be integrally formed with the mating tongue and the base portion, each of the terminals defining a horizontal portion with a contacting section exposed upon the mating tongue, a tail portion bending out of the base portion for mounting to a printed circuit board, and a connecting portion linked between the horizontal portion and the tail portion with a retaining section fully embedded within the base portion without exposure;

wherein the horizontal portion is provided in a rectangular shape, and at least a portion of the retaining section is provided with an arc-shaped peripheral surface.

9. The electrical connector as described in claim 8, wherein the portion of the retaining section having the arc-shaped peripheral surface is provided in a round shape.

10. The electrical connector as described in claim 8, wherein the connecting portion comprises a barb portion linked between the horizontal portion and the retaining section.

11. The electrical connector as described in claim 8, wherein the housing comprises a mating frame unitarily forwardly extending from the base portion in the mating direction to surround the mating tongue and dispose the mating tongue in a mating cavity, the horizontal portion is disposed in the mating cavity.

12. The electrical connector as described in claim 11, wherein the mating frame defines opposite upper and lower walls both parallel to the mating tongue, and a pair of side walls respectively connecting with the upper and lower walls at two sides thereof, each side wall is perpendicular to the mating tongue.

13. The electrical connector as described in claim 12, wherein at least one of the side walls provides a retaining slot at a peripheral face thereof, and a metal ear is provided to be retained in the corresponding retaining slot.

14. The electrical connector as described in claim 8, further comprising a waterproof plate attached to a rear portion of the base portion, wherein the tail portions extend out of the waterproof plate.

15. An electrical connector comprising:

an insulative housing defining a base portion;

a plurality of contacts disposed in the housing, each of said contacts including a front mating section, a rear tail section and a middle retaining section therebetween in a front-to-back direction;

the front contacting section and the rear tail section being of a rectangular cross-section while the middle retaining section at least partially being of a circular cross-section; and the said base portion integrally formed with said contacts via an insert-molding process; wherein each of said contacts is intimately surrounded by the base portion, in a front-to-back direction, at portions thereof with the rectangular cross-section and those with the circular cross-section.

16. The electrical connector as claimed in claim 15, wherein said circular cross-section is larger than the rectangular cross-section.

17. The electrical connector as claimed in claim 15, wherein a waterproof plate is attached behind the base portion and behind the retaining sections of the contacts in the front-to-back direction.

18. The electrical connector as claimed in claim 15, wherein each of said contacts defines a Z-shaped configuration in a side view, and said contacting section and said retaining section are aligned with each other in the front-to-back direction.

19. The electrical connector as claimed in claim 15, wherein in each of said contacts, a barbed portion is located in front of the retaining section with the circular cross-section thereof.

* * * * *